US005454890A

United States Patent [19]

Evans et al.

[11] Patent Number: 5,454,890

[45] Date of Patent: Oct. 3, 1995

[54] CAP-SENSITIVE PACKAGED EMULSION EXPLOSIVE

[75] Inventors: William B. Evans; Anh D. Nguyen, both of Brossard, Canada

[73] Assignee: ICI Canada Inc., Ontario, Canada

[21] Appl. No.: 14,627

[22] Filed: Feb. 8, 1993

[30] Foreign Application Priority Data

Feb. 12, 1992 [CA] Canada ..... 2061049

[51] Int. Cl.[6] ..... C06B 31/32

[52] U.S. Cl. ..... 149/46; 149/2; 149/110

[58] Field of Search ..... 149/46, 2, 110

[56] References Cited

U.S. PATENT DOCUMENTS 4,908,079 3/1990 Tasaki et al. ..... 149/2

5,034,071 7/1991 VanOmmeren ..... 149/7

5,076,867 12/1991 McKenzie ..... 149/2

*Primary Examiner*—Donald P. Walsh

*Assistant Examiner*—Anthony R. Chi

*Attorney, Agent, or Firm*—Charles Q. Buckwalter

[57] ABSTRACT

A cap-sensitive emulsion explosive capable of being used in packaged explosive products. The explosive contains ammonium nitrate prills of a bulk density of 0.70 to 1.00 g/cc, with a particle density of 1.25 to 1.40 g/cc. A polysuccinic anhydride based emulsifying agent is used as an emulsifying agent. Packaged explosives prepared according to the present invention have improved package stability, and allow for control of the ratio of shock energy to heave energy.

2 Claims, No Drawings

CAP-SENSITIVE PACKAGED EMULSION EXPLOSIVE

FIELD OF THE INVENTION

The present invention relates to emulsion explosives and, in particular, to emulsion explosives having modified explosive properties.

DESCRIPTION OF THE RELATED ART

Emulsion explosives have become well known in commercial blasting. These blasting agents, as described by Bluhm in U.S. Pat. No. 3,447,978, typically comprise a discontinuous aqueous oxidizer salt phase and a continuous phase of a water-insoluble liquid or liquefiable fuel. The emulsion is typically stabilized by the addition of a suitable emulsifying agent. This base emulsion explosive will detonate under suitable conditions. However, additives are frequently included in the composition to modify the blasting properties of the explosive.

Emulsion explosives are characterized by a close proximity between the fuel and the oxidizing phase (typically on the micron size order), and a dependence on gas bubble, or occluded voids, as the main sensitizing mechanism. With the close intimacy between fuel and oxidizer, emulsion explosives are higher in detonation velocity, higher in detonation pressure, and generally provide more shock energy than other commercially used explosives such as ammonium nitrate-fuel oil (ANFO) explosives, or dynamite. Therefore, emulsion explosives are generally more suitable for blasting hard rock or competent ground where high brisant explosives are required. The performance of emulsion explosives in common fractured rocks, or weak ground, where high heave explosives, or more generally, where explosives with a high gas energy, are desirable, is less than satisfactory.

Explosives which comprise a blend of a water-in-oil emulsion and a solid particulate such as ammonium nitrate, are also known in the blasting industry as doped emulsions. These blends can provide the advantages of high bulk density and the blasting characteristics of emulsion explosives. Typically, however, these blends have been found to have a short shelf life.

A short shelf life means that an explosive product lacks stability, undergoing deleterious changes in structure and/or composition to the degree that it cannot be depended upon to detonate at the required velocity at the required time. If the products shelf life is very short, it is likely unsuitable for use in packaged form, and may be unsuitable for bulk use.

SUMMARY OF THE INVENTION

It is thus an object of the present invention to provide an emulsion explosive which is cap sensitive, and which may be used as a packaged explosive.

It is a further object of the present invention to provide an emulsion explosive having a modified partition between shock and gas energy.

It is still a further object to provide an emulsion explosive, sensitized by glass microballoons which is more resistant to shock desensitization.

These, and other objects, are accomplished by providing a cap-sensitive, packaged explosive comprising:

i) 50 to 90% by weight of the explosive of an emulsion explosive having a continuous fuel oil phase, a discontinuous phase of an oxidizer salt, and a polysuccinic anhydride based emulsifying agent; and ii) 10 to 50% by weight of the explosive, of an ammonium nitrate particle, wherein said ammonium nitrate particles have a bulk density of 0.70 to 1.00 g/cc, and a particle density of 1.25 to 1.40 g/cc, and greater than 90% of said ammonium nitrate particles are greater than 1.0 mm in diameter.

Preferably, the explosive comprises 70 to 80% by weight of the emulsion explosive, and 20 to 30% by weight of the ammonium nitrate particle.

The emulsion also preferably comprises ammonium nitrate having a bulk density of 0.75 to 0.80 g/cc, and a particle density of 1.30 to 1.35 g/cc. Further, it is preferred that the explosive comprises ammonium nitrate wherein at least 97% of the ammonium nitrate particles are larger than 1.18 mm in diameter.

The large diameter of the ammonium nitrate particles is particularly useful in the present invention since the large particles have been found to provide protection to the glass microballoons, described hereinbelow, so that the explosive prepared has greater resistance to pressure desensitization.

Pressure desensitization is caused, at least in part, by the collapse of the sensitizing microballoons in the explosive due to the shock wave that emanates from the detonated explosive an adjacent borehole. It is believed that the relatively large ammonium nitrate particles shield the microballoons from this shock wave.

Accordingly, in a preferred embodiment, the present invention also provides a cap-sensitive, packaged explosive as describe hereinabove, which is resistant to pressure-desensitization.

The ammonium nitrate particles may also optionally be coated with talc and naphthalene sulphonate, as anti-caking agents, and in order to improve the compatibility of the ammonium nitrate with the emulsion matrix.

The present invention is of most utility in the production of packaged cap-sensitive explosives, and in particular, packaged explosives having a unusually small diameter. Packaged, cap-sensitive explosives may be prepared in cylindrical containers of less than 10 cm., 7.5 cm. or most preferably, from 2.5 to 5 cm., in diameter.

The addition of ammonium nitrate to the emulsion explosive also provides a method to control the energy partition of the resultant packaged explosive. Energy partition is defined as the ratio of the shock energy to the bubble energy, or gas energy, of an explosive formulation. The method of defining the energy partition is described in the examples.

It is desirable to be able to control the energy partition of an explosive in order to adjust the degree of gas energy to shock energy, in order to customize the explosive properties for the type of blasting to be conducted. It is preferred that the explosive formulation of the present invention have an energy partition of between 1.30 and 1.60, and more preferably between 1.40 and 1.55.

DESCRIPTION OF THE PREFERRED EMBODIMENTS

The oxidizer salt for use in the discontinuous phase of the emulsion is preferably selected from the group consisting of alkali and alkaline earth metal nitrates, chlorates and perchlorates, ammonium nitrate, ammonium chlorates, ammonium perchlorate and mixtures thereof. It is particularly preferred that the oxidizer salt is ammonium nitrate, sodium nitrate, or a mixture of ammonium and sodium nitrate.

A preferred oxidizer salt mixture comprises a solution of

77% ammonium nitrate, 11% sodium nitrate and 12% water.

The oxidizer salt is typically a concentrated aqueous solution of the salt or mixture of salts. However, the oxidizer salt may also be a liquefied, melted solution of the oxidizer salt where a lower water content is desired.

It is particularly preferred that the discontinuous phase of the emulsion explosive be a eutectic composition. By eutectic composition it is meant that the melting point of the composition is either at the eutectic or in the region of the eutectic or the components of the composition.

The oxidizer salt for use in the discontinuous phase of the emulsion may further comprise a melting point depressant. Suitable melting point depressants for use with ammonium nitrate in the discontinuous phase include inorganic salts such as lithium nitrate, silver nitrate, lead nitrate, sodium nitrate, potassium nitrate; alcohols such as methyl alcohol, ethylene glycol, glycerol, mannitol, sorbitol, pentaerythritol; carbohydrates such as sugars, starches and dextrins; aliphatic carboxylic acids and their salts such as formic acid, acetic acid, ammonium formate, sodium formate, sodium acetate, and ammonium acetate; glycine; chloracetic acid; glycolic acid; succinic acid; tartaric acid; adipic acid; lower aliphatic amides such as formamide, acetamide and urea; urea nitrate; nitrogenous substances such as nitroguanidine, guanidine nitrate, methylamine, methylamine nitrate, and ethylene diamine dinitrate; and mixtures thereof.

Typically, the discontinuous phase of the emulsion comprises 60 to 97% by weight of the emulsion explosive, and preferably 86 to 95% by weight of the emulsion explosive.

The continuous water-immiscible organic fuel phase of the emulsion explosive comprises an organic fuel. Suitable organic fuels for use in the continuous phase include aliphatic, alicyclic and aromatic compounds and mixtures thereof which are in the liquid state at the formulation temperature. Suitable organic fuels may be chosen from fuel oil, diesel oil, distillate, furnace oil, kerosene, naphtha, waxes, (e.g. microcrystalline wax, paraffin wax and slack wax), paraffin oils, benzene, toluene, xylenes, asphaltic materials, polymeric oils such as the low molecular weight polymers of olefins, animal oils, fish oils, and other mineral, hydrocarbon or fatty oils, and mixtures thereof. Preferred organic fuels are liquid hydrocarbons, generally referred to as petroleum distillate, such as gasoline, kerosene, fuel oils and paraffin oils. More preferably the organic fuel is paraffin oil.

The fuel phase may additionally comprise a synthetic wax, such as for example, a polyethylene wax. A preferred formulation comprises a fuel phase having a fraction of paraffinic wax, and having a weight ratio of polyethylene wax to paraffinic wax of at least 2 to 1.

Typically, the continuous water-immiscible organic fuel phase of the emulsion explosive comprises 3 to 30% by weight of the emulsion explosive, and preferably 5 to 15% by weight of the emulsion explosive.

The emulsion explosive of the present invention also comprises a polysuccinic anhydride based emulsifying agent to aid in the formation of the emulsion, and to improve the stability of the emulsion.

Preferably the emulsifier component comprises a condensation product of a compound comprising a polysuccinic acid or anhydride, and preferably having at least one primary amine. A preferred emulsifier is a polyisobutylene succinic anhydride (PIBSA) based surfactant, which surfactants are described in Canadian Patent No. 1,244,463 (Baker). U.S. Pat. No. 4,822,433 (Cooper and Baker) discloses emulsion explosive compositions in which the emulsifier is a condensation product of a polysuccinic anhydride and an amine such as ethylene diamine, diethylene triamine and ethanolamine. Further examples of preferred condensation products may be found in U.S. Pat. No. 4,999,062.

Typically, the emulsifier component, comprising the emulsifying agent, of the emulsion explosive comprises up to 5% by weight of the emulsion explosive composition. Higher proportions of the emulsifier component may be used and may serve as a supplemental fuel for the composition, but in general it is not necessary to add more than 5% by weight of emulsifier component to achieve the desired effect. Stable emulsions can be formed using relatively low levels of emulsifier component and for reasons of economy, it is preferable to keep to the minimum amounts of emulsifier necessary to achieve the desired effect. The preferred level of emulsifier component used is in the range of from 0.4 to 3.0% by weight of the emulsion explosive.

The emulsion explosive of the present invention may additionally comprise a co-surfactant mixture, which co-surfactant mixture preferably comprises at least 50% of a polysuccinic anhydride based surfactant.

A preferred co-surfactant may be selected from the group consisting of sorbitan oleate, ethoxylated fatty esters and fatty acid esters.

The formulation may additionally comprise further emulsifying agents selected from the wide range of emulsifying agents known in the art to be suitable for the preparation of emulsion explosive compositions. Examples of such emulsifying agents include alcohol alkoxylates, phenol alkoxylates, poly(oxyalkylene)glycols, poly(oxyalkylene) fatty acid esters, amine alkoxylates, fatty acid esters of sorbitol and glycerol, fatty acid salts, sorbitan esters, poly(oxyalkylene) sorbitan esters, fatty amine alkoxylates, poly(oxyalkylene)glycol esters, fatty acid amides, fatty acid amide alkoxylates, fatty amine, quaternary amines, alkyloxazolines, alkenyloxazolines, imidazolines, alkyl-sulfonates, alkylarylsulfonates, alkylsulfosuccinates, alkylphosphates, alkenylphosphates, phosphate esters, lecithin, copolymers of poly(oxyalkylene) glycols and poly(12-hydroxystearic acid), and mixtures thereof.

If desired other, optional fuel materials, hereinafter referred to as secondary fuels, may be incorporated into the emulsion explosives. Examples of such secondary fuels include finely divided solids. Examples of solid secondary fuels include finely divided materials such as: sulfur; aluminum; carbonaceous materials such as gilsonite, comminuted coke or charcoal, carbon black, resin acids such as abietic acid, sugars such as glucose or dextrose and other vegetable products such as starch, nut meal, grain meal and wood pulp; and mixtures thereof.

Typically, the optional secondary fuel component of the emulsion explosive comprises from 0 to 30% by weight of the emulsion explosive.

The explosive composition is preferably oxygen balanced. This may be achieved by providing a blend of components which are themselves oxygen balanced or by providing a blend which, while having a net oxygen balance, comprises components which are not themselves oxygen balanced. This provides a more efficient explosive composition which, when detonated, leaves fewer unreacted components. Additional components may be added to the explosive composition to control the oxygen balance of the explosive composition.

The explosive composition may additionally comprise a discontinuous gaseous component which gaseous component can be utilized to vary the density and/or the sensitivity of the explosive composition.

The methods of incorporating a gaseous component and the enhanced sensitivity of explosive compositions comprising gaseous components are well known to those skilled in the art. The gaseous components may, for example, be incorporated into the explosive composition as fine gas bubbles dispersed through the composition, as hollow particles which are often referred to as microballoons, microbubbles, or as microspheres, as porous particles, or mixtures thereof.

A discontinuous phase of fine gas bubbles may be incorporated into the explosive composition by mechanical agitation, injection or bubbling the gas through the composition, or by chemical generation of the gas in situ.

Suitable chemicals for the in situ generation of gas bubbles include peroxides, such as hydrogen peroxide, nitrosoamines, such as N,N'-dinitrosopentamethylenetetramine, alkali metal borohydrides, such as sodium borohydride, and carbonates, such as sodium carbonate. Preferred chemical for the in situ generation of gas bubbles are nitrous acid and its salts which decompose under conditions of acid pH to produce gas bubbles. Preferred nitrous acid salts include alkali metal nitrites, such as sodium nitrite. Catalytic agents such as thiocyanate or thiourea maybe used to accelerate the decomposition of a nitrite gassing agent. Suitable small hollow particles include small hollow microspheres of glass or resinous materials, such as phenol-formaldehyde, urea-formaldehyde and copolymers of vinylidene chloride and acrylonitrile. Suitable porous materials include expanded minerals such as perlite, and expanded polymers such as polystyrene.

Accordingly, the present invention provides a cap-sensitive, packaged explosive as described hereinabove, additionally comprising a void sensitizing material. A preferred sensitizing material is glass microballoons, which may be present in an amount of from 1 to 10%, and more preferably 2 to 5% by weight of the total formulation.

Preferably, in order to provide additional protection against pressure-desensitization, it is preferred that less than 10% of said void sensitizing material collapse at a dynamic pressure of less than 500 psi.

EXAMPLES

The invention will now be described, by way of example only, by the following non-limiting examples.

Experimental Procedures

Emulsion Preparation

Emulsion explosives were made in a Hobart mixer equipped with a stem jacketed 5-liter capacity mixing bowl and a standard whisk. Surfactants and paraffin oil were first weighed out in the mixing bowl and heated to 90°–100° C. The oxidizing salts liquor was prepared separately, kept at 90°–95° C., and added to the heated oil phase with the mixer running at 285 RPM to form a coarse emulsion. After the coarse emulsion was formed, it was refined for 3 minutes at high mixing speed (591 RPM). Glass microbubbles and particulate nitrate salts such as AN-Prill were then blended into emulsion manually before packaging for testing.

Testing Procedures

Density: The density was determined by the weight to volume ratio.

Sensitivity: Sensitivity was measured by a series of detonator caps with increasing PETN base charge.

| Detonator | Base Charge (g PETN) |
|---|---|
| R6 | 0.15 |
| R7 | 0.20 |
| R8 | 0.25 |
| R9 | 0.30 |
| R10 | 0.35 |
| EB | 0.78 |

*Electric Blasting Detonator

Detonation Velocity (VOD): The VOD was determined by the time which the detonation wave takes to travel 2.5 or 5 inches distance in a specified charge diameter.

Underwater Test: The shock and bubble energy generated by an explosive based on the measured pressure and the size of bubble formed when detonated under water.

Shock Desensitization: The resistance to dynamic shock desensitization of an explosive is determined by its ability to retain or to lose the sensitivity to an electric blasting detonator 4 seconds after receiving the pressure shock from a 250 g Pentolite charge located 1 meter away in water.

Example 1

Sensitivity of Doped Emulsion Explosives

To demonstrate the effect of density on the sensitivity of doped emulsion, a series of emulsions containing 20% AN-Prills were made with decreasing glass microbubbles and tested for sensitivity and VOD in 25, 32 and 50 mm diameter size.

TABLE 1

Sensitivity of AN-Prills Doped Emulsion Explosives

| | Formulation | | | |
|---|---|---|---|---|
| Ingredient % w/w | 1 | 2 | 3 | 4 |
| PIBSA Surfactant | 1.8 | 1.8 | 1.8 | 1.8 |
| Sorbitan Oleate | 0.5 | 0.5 | 0.5 | 0.5 |
| Paraffin Oil | 3.3 | 3.3 | 3.3 | 3.3 |
| Oxidizing Salts Liquor* | 70.4 | 71.4 | 72.4 | 72.9 |
| AN-Prills | 20.0 | 20.0 | 20.0 | 20.0 |
| Glass Microbubbles | 4.0 | 3.0 | 2.0 | 1.5 |
| Density g/cc | 1.15 | 1.21 | 1.26 | 1.30 |
| Detonator Sensitivity | R-5 | R-7 | Failed | Failed |
| V.O.D. m/sec | | | | |
| 25 mm | 4205 | 4233 | Failed | Failed |
| 32 | 4410 | 4441 | Failed | Failed |
| 50 | 4509 | 4774 | 4601 | Failed |

*Oxidizing Salts Liquor: 77% ammonium nitrate, 11% sodium nitrate and 12.0% water.
Failed-Failed to detonate with an electric detonator (EB)

The results showed that emulsion containing 20% AN Prills are sensitive to detonators at densities below 1.26 g/cc in small diameter charges.

Example 2

Sensitivity of Doped Emulsion Explosives

Formulation 5 in Table 2 is an equivalent emulsion without AN-Prills doping. Formulations 6 and 7 are two emulsions respectively containing 25 and 30% AN-Prills.

TABLE 2

Sensitivity of Doped Emulsion Explosives

| Ingredient % w/w | Formulation 5 | 6 | 7 |
|---|---|---|---|
| PIBSA Surfactant | 1.8 | 1.8 | 1.8 |
| Sorbitan Oleate | 0.5 | 0.5 | 0.5 |
| Paraffin Oil | 3.0 | 2.9 | 2.6 |
| Oxidizing Salts Liquor* | 90.2 | 66.0 | 61.6 |
| AN-Prills | — | 25.0 | 30.0 |
| Glass Microbubbles | 4.5 | 3.8 | 3.5 |
| Density g/cc | 1.15 | 1.16 | 1.22 |
| Sensitivity | R-5 | R-6 | R-8 |
| V.O.D. m/sec | | | |
| 25 mm | 4568 | 3969 | 4150 |
| 32 | 4739 | 4292 | 4233 |
| 50 | 5121 | 4774 | 4441 |

*Oxidizing Salt Liquor: 77% AN, 11% SN, 12.0% water.

Data indicated that the VOD of emulsions containing AN-Prills are somewhat lower than the VOD of the non-doped emulsion.

Example 3

Energy Partition in AN-Prills Doped Emulsion

To illustrate the partition of energy in doped emulsion, the shock and bubble energy were measured in the underwater test. Similar measurements were done on emulsion, nitroglycerin based explosive, Ethylene glycol mononitrate based water gel slurry explosive, and ANFO for comparison purpose.

emulsion is a high brisant explosive while ANFO is a high heave explosive, and doped emulsion, NG gelatin, and EGMN slurry are in between.

In commercial blasting, too high shock energy or heavy energy are undesirable. Therefore, emulsion is only suitable for blasting hard rock while ANFO is particularly suitable for soft ground. NG explosives, on the other hand, are well known to be a highly effective explosive with a good balance between bubble and shock energy. Doped emulsion, with the Eb/Es value of 1.49 close to that of NG gelatin (1.60), is therefore expected to perform better than emulsion itself. From the above, it was found that:

AN Prills can be used to alter the bubble to shock energy ratio in emulsion explosive AN Prill doped emulsion is higher in bubble energy, lower in shock energy than non-doped emulsion The energy partition in doped emulsion is similar to the energy partition in NG based explosive Example 4

Resistance to Dynamic Pressure

Glass microbubbles used to sensitize emulsion are between 20 to 130 micron size with wall thickness of 0.5 to 2.0 micron. The microbubbles start to collapse at about 150 to 230 psi pressure. Since the dynamic pressure from adjacent boreholes may reach 1000 psi or above, glass microbubbles can break under dynamic pressure resulting in desensitized explosives. AN-Frills on the other hand, range from 1.7 to 2 mm in diameter. Therefore, they are 20 to 40 times large in diameter, or 8000 to 64,000 times larger in volume than microbubbles.

In AN-Prill doped emulsion, AN-Prills are able to absorb shock wave energy and thereby protect the smaller glass microbubbles from the dynamic pressure shock. This results in a better resistance to dynamic pressure of AN-Prill doped emulsion.

TABLE 3

Energy Partition in Explosives (MJ/kg)

| Form No. | Description | Calculated Energy Ec (MJ/kg) | Bubble Energy Eb (MJ/kg) | Shock Energy Es (MJ/kg) | Total Measured Energy Et (MJ/kg) | Efficiency (%) | Energy Partition Eb/Es |
|---|---|---|---|---|---|---|---|
| 8 | Emulsion | 3.00 | 1.56 | 1.26 | 2.82 | 94 | 1.24 |
| 9 | Doped Emulsion | 3.25 | 1.65 | 1.11 | 2.76 | 85 | 1.49 |
| 10 | NC Gelatin | 3.97 | 2.20 | 1.37 | 3.57 | 90 | 1.60 |
| 11 | EGMN Slurry | 4.09 | 2.10 | 0.80 | 3.90 | 71 | 2.62 |
| 12 | ANFO | 3.72 | 1.85 | 0.38 | 2.23 | 60 | 4.87 |

Notes to Table 3
Calculated Energy Ec: The theoretical value calculated based on the explosive composition.
Bubble Energy Eb: The measured gas energy generated by the explosive in the underwater test.
Shock Energy Es: The total measured gas energy and shock energy generated in the underwater test.
Total Measured Energy Et: The total measured gas energy and shock energy generated in the underwater test.
Efficiency %: The ratio of Et to Ec × 100.
Energy Partition Eb/Es: The ratio of bubble energy to shock energy as measured in the underwater test.
Form. 8: An emulsion explosive as in formulation 5 tested in 50 mm diameter, 500 g charge.
Form. 9: A doped emulsion explosive as in formulation 1 tested in 50 mm diameter, 500 g charge.
Form. 10: A NG-based gelatin explosive containing 27% NG tested in 50 mm diameter, 500 g charge.
Form. 11: An EGMN water gel slurry explosive containing 5% fuel aluminum tested in 50 mm diameter, 500 g charge.
Form. 12: An ANFO made of 94% AN Prill, 6% Fuel Oil tested in 75 mm diameter, 500 g charge.

As indicated in Table 3, a standard emulsion is the lowest in the energy partition following by doped emulsion, NG gelatin, EGMN slurry, and ANFO. This simply means that Formulations 13, 14 and 15 are used to illustrate the effect of AN-Prills on the resistance to dynamic pressure.

TABLE 4

| Resistance to Dynamic Pressure | | |
|---|---|---|
| Form. No. | Description | Dynamic Pressure |
| 13 | Emulsion | Failed |
| 14 | 20% Grained AN | Failed |
| 15 | 20% AN-Prills | Detonated |

Remarks:
Form. 13: Non-doped emulsion as in formulation 5
Form. 14: Emulsion as in formulation 1 containing 20% grained AN (with particle size of 100–110 micron) in place of 20% AN-Prills
Form. 15: AN-Prill doped emulsion as in formulation 1
Dynamic Pressure Test: The explosive is tested for detonation with an EB detonator 4 seconds after receiving the pressure shock from a 250 g Pentolite charge located 1 meter away underwater The results obtained indicated that:

Glass microbubble sensitized emulsions are prone to pressure desensitization

Glass microbubble sensitized emulsions containing fine particulate salts are prone to pressure sensitization Glass microbubble sensitized emulsions containing large particulate salts of 1 to 3 mm diameter size as AN-Prills are more resistant to pressure desensitization.

Example 5

Stability of AN-Prill Doped Emulsion

One difficulty in making detonator sensitive, small diameter, packaged emulsions doped with solid particulate salts is the storage stability of the packaged product. In the presence of particulate salts, the emulsions formed tend to be poorer in oil phase stability at the solid-emulsion interface which leads to premature crystallization of the emulsion. It has been found, however, that premature crystallization of doped emulsions can be prevented by using a PIBSA based surfactant with a PIBSA molecular weight of from 450 to 2000. These results are illustrated by the following comparison stability test.

TABLE 5

| Stability of AN-Prill Doped Emulsion | | |
|---|---|---|
| | Formulation No. | |
| Ingredient % w/w | 16 | 17 |
| PIBSA Surfactant | 1.8 | |
| Sorbitan Oleate | 0.5 | 0.9 |
| Lecithin | | 0.9 |

TABLE 5-continued

| Stability of AN-Prill Doped Emulsion | | | | |
|---|---|---|---|---|
| | Formulation No. | | | |
| Ingredient % w/w | 16 | | 17 | |
| Paraffin Oil | 3.3 | | 3.3 | |
| Oxidizing Salt Liquor* | 70.4 | | 70.9 | |
| AN-Prills | 20.0 | | 20.0 | |
| Glass Microbubbles | 4.0 | | 4.0 | |
| Density (g/cc) | 1.17 | | 1.17 | |
| Detonation Stability | Month | 32 mm | Week | 25 mm |
| | 0 | R5 | 0 | RS |
| | 7 | R6 | 3 | RS |
| | 10 | R6 | 6 | Failed |
| | 14 | R8 | | |

*Oxidizing Salt Liquor: 77% AN, 11% SN, 12% Water

Formulation 16 is a AN-Prill doped emulsion made with a PIBSA based surfactant in accordance with the present invention. Formulation 17 is a typical AN-Prill doped emulsion made with Sorbitan Oleate surfactant, and lecithin co-surfactant. In storage tests, the PIBSA based surfactant doped emulsion did not show any change in sensitivity after 10 months, while formulation 17 failed to detonate with an EB detonator after 6 weeks storage. Having described specific embodiments of the present invention, it will be understood that modifications thereof may be suggested to those skilled in the art, and it is intended to cover all such modifications as fall within the scope of the appended claims.

We claim:

1. A cap sensitive, packaged emulsion explosive comprising:

a) ammonium nitrate particles having a bulk density of 0.70 to 1.00 grams per cubic centimeter, a particle density of 1.25 to 1.40 grams per cubic centimeter, and greater than 90% of said ammonium nitrate particles are greater than 1.0 mm in diameter, b) a PIBSA-based surfactant, c) 1 to 10% by weight microballoons, d) wherein said explosive is resistant to pressure desensitization and comprises an energy partition ratio of bubble energy to shock energy between 1.30 and 1.60.

2. The explosive of claim 1 wherein said energy partition is between 1.40 and 1.55.

* * * * *